United States Patent [19]

Weber et al.

[11] Patent Number: 4,801,075

[45] Date of Patent: Jan. 31, 1989

[54] COMPLETELY OPENABLE PACKING WRAPPER IN PARTICULAR FOR PASTY FOOD PRODUCTS

[75] Inventors: Jean-Claude Weber, Bondy; Jean-Claude Mitaine, Voiteur, both of France

[73] Assignee: Fromageries Bel, Paris, France

[21] Appl. No.: 38,578

[22] Filed: Apr. 15, 1987

[30] Foreign Application Priority Data

Apr. 16, 1986 [FR] France ..... 86 05465

[51] Int. Cl.[4] ..... B65D 17/00

[52] U.S. Cl. ..... 229/87 F; 206/551; 206/605; 206/628; 426/123

[58] Field of Search ..... 229/87 F, 107, 115; 206/628, 605, 551; 426/122, 123

[56] References Cited

U.S. PATENT DOCUMENTS 3,412,927 11/1968 Baur ..... 229/87 F
3,924,803 12/1975 Habsburg ..... 229/87 F

FOREIGN PATENT DOCUMENTS 1122295 9/1956 France .
1196277 11/1959 France ..... 229/87 F
1355660 2/1964 France ..... 206/628
1548883 10/1968 France .
2073019 9/1971 France .
317968 8/1929 United Kingdom ..... 229/87 F

*Primary Examiner*—Stephen P. Garbe
*Attorney, Agent, or Firm*—Sughrue, Mion, Zinn, Macpeak and Seas

[57] ABSTRACT

A completely openable fluidtight packing wrapper for pasty products and in particular food products such as processed cheese. This wrapper comprises a shell having a bottom (2) of triangular shape bordered by two lateral walls (6, 7) and a wall forming a heel (8). A tearing element (24) comprises two tearing strips (25, 26) each extending in a first portion (27, 32) along one of the lateral edges (22, 23) of the heel (8) and in a direction parallel to this edge and, in a second portion (28, 33) along one of the lateral edges (4, 3) of the bottom (2) and in a direction parallel to this edge, these two strips (25, 26) being at least partly superposed in a third portion (29, 34) in the vicinity of the point (30) of the triangular bottom (2) so as to constitute a single pulling tongue (31) which extends beyond the sheet (1) forming the shell.

6 Claims, 2 Drawing Sheets

COMPLETELY OPENABLE PACKING WRAPPER IN PARTICULAR FOR PASTY FOOD PRODUCTS

The invention relates to a fluidtight packing wrapper which is capable of being completely opened for a pasty product and in particular for food products such as processed cheese.

Many wrapping systems are found on the market or described in the literature which may be so-called easily opened; unfortunately, most of these systems do not allow a complete opening of the portion; parts of the cheese remain in the wrapper and the consumer must touch the cheese in order to completely remove the product.

Some patents have described systems whereby it is possible to achieve a complete opening, but they still possess drawbacks.

Thus, FR-A No. 2 362 765 discloses a wrapper for pasty products which comprises a tearing element in the form of a fork. This system has several drawbacks: on one hand, it can only be in practice applicable to square or parallelepipedic portions; on the other hand, after the tearing of the opening strip by pulling on the coinciding ends of the tearing element, only a central portion of the lateral side is removed and the corners of this side remains intact, which does not permit a complete release of the pasty product contained therein.

The European patent 057644 also discloses a tearing system which, in being applied to square or parallelepipedic portions, provides along the folding lines which laterally delimit the opening strip of the wrapper, reinforcing strips which adhere to the first sheet from which this strip is taken and guide the progression of the tear when opening the wrapper.

While this system is fully satisfactory as concerns the completeness of the opening of square or parallelepipedic portions, its adaptation to triangular portions presents serious difficulties:

it requires, at the moment of wrapping for the closure of the portion, many folds of the aluminum paper, which is, on one hand, expensive as concerns this material and, on the other hand, does not afford all the sealing property required in the region of the wrapper to ensure a good preservation;

upon opening, at the moment of taking hold of the tongue for starting the tear, the tongue exerts a force on the entire length of the heel and not a force concentrated on a tearing point, which eliminates a distinct initiation of the tear and can result in a crushing of the cheese owing to an excessive pressure exerted by the fingers.

There may also be mentioned the patent U.S. Pat. No. 3,412,927 which discloses an opening system comprising two straight tearing strips located in the vicinity of the edges of heel and along the lateral edges of the bottom, these strips being joined in the region of the point of the portion where they intersect by forming portions of sufficient size to extend beyond the point and perform the function of a gripping tongue.

Unfortunately, this system has the drawback of a holding defect owing to lack of superposition of the two portions, the consumer only taking hold of a single one thereof. Further, the straight cutting out of the two strips does not permit a superposition of the strips with the edges of the heel and this results in leaving processed cheese along the edges and the corners. Consequently, this system does not afford a complete and correct opening in any way.

An object of the present invention is to provide a wrapper for products having a triangular base which completely avoids the drawbacks of the various existing systems and which permits a so-called complete opening of the portions of cheese.

The invention therefore provides a fluidtight packing wrapper capable of being completely opened for pasty products, in particular food products such as processed cheese, having a triangular base, said wrapper comprising two thin sheets, namely a first sheet cut out along a suitable contour and shaped as a shell by folding in such manner as to form a bottom of triangular shape, bordered by two lateral walls and a wall constituting a heel, and a sheet placed flat on the surface of the product to be packed previously placed in said shell, and a tearing element fixed to the interior of the shell and including a pulling tongue, wherein the tearing element comprises two tearing strips each extending in a first part along one of the lateral edges of the heel, and parallely to said edge and in a second part along one of the lateral edges of the bottom and parallely to said edge, said two strips being superposed at least partly in a third part in the vicinity of the point of the triangular bottom so as to form a single pulling tongue which extends beyond the sheet constituting the shell.

Advantageously, in order to facilitate the folding in the region of the point in an advantageous manner, the third parts of the two strips which are superposed at least partly are disposed on the same side of the median axis of the triangular bottom and along the latter.

In a preferred embodiment of the invention, the folding of the wrapper in the region of the heel is achieved in such manner that two triangles formed along the lateral edges of the heel are folded onto the lateral walls and not onto the heel as is usually the case in conventional folding. This manner of folding results in an additional resistance of the lateral walls along the lateral edges of the heel which facilitates the tearing along said edges.

The two tearing strips constituting the tearing element are in particular two strips cut out in a suitable manner and welded to each other in their superposition zone.

These tearing strips may be made from materials conventionally employed for this purpose such as sheets of aluminum, polypropylene or laminated materials. They usually comprise a layer of thermoweldable lacquer which permits, by means of a single thermowelding operation, the welding of the strips together and the fixing on the sheet constituting the shell.

The sheets forming the wrapper are preferably of aluminum but may also be made from different materials suitable for food products.

It will be understood that, in the present invention, the products having a triangular base are also those having a base whose sides are straight and those having a base of which at least one of the sides is curved, and in particular those having a base in the shape of a sector of a circle.

The invention will be described hereinafter in more detail with reference to the accompanying drawings, in which.

Figure 1:
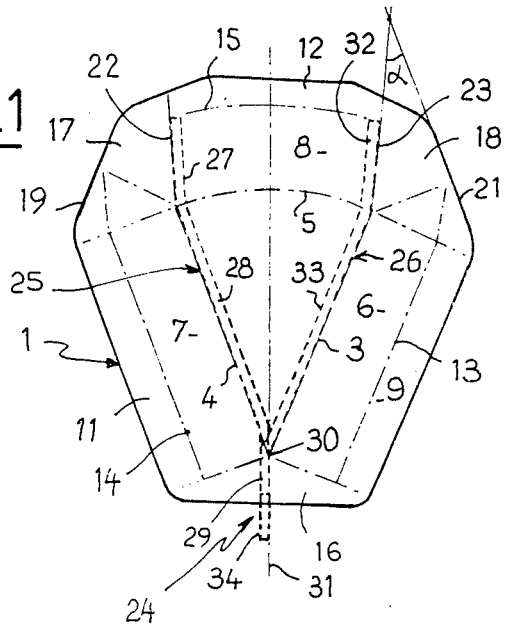
FIG. 1 is a plan view of a first sheet of a wrapper according to the invention before folding.
Figure 2:
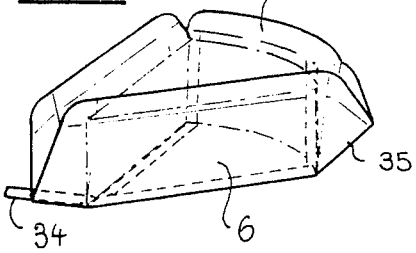
FIG. 2 is a perspective view of the sheet of FIG. 1 in process of being folded.
Figure 3:
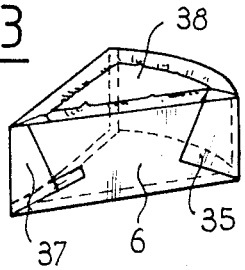
FIG. 3 is a perspective view of the finished wrapper.

The wrapper sheet 1 shown in FIGS. 1 and 2 is intended for the packing of processed cheese in the form of a portion having a base in the shape of a sector of a circle. The cutting out of such wrappers is conventional.

As shown in FIG. 2, the sheet is shaped as a shell by folding along lines represented in dot-dash lines in FIG. 1. This shell comprises a bottom 2 in the shape of a sector of a circle defined by two rectilinear edges 3 and 4 and an edge in the shape of an arc of a circle. In the direction perpendicular to the plane of the bottom 2, the shell has two lateral walls 6 and 7 along the rectilinear edges 3 and 4 and a curvilinear wall constituting a heel 8 along the edge 5 in the shape of an arc of a circle. The walls 6, 7 and 8 are extended by marginal portions 9, 11 and 12 adapted to be folded over along the fold lines 13, 14 and 15 when the wrapper is closed.

Before folding, the sheet 1 has intermediate zones 16, 17 and 18 respectively between the zones forming the walls 6 and 7 (and their marginal portions 9 and 11) between the zones forming the walls 7 and 8(and their marginal portions 11 and 12)and between the zones forming the walls 6 and 8 (and their marginal portions 9 and 12). The zones 17 and 18 have an edge 19 and 21 respectively forming an angle $\alpha$ of about 20° to 35° with the lateral edges 22 and 23 of the zone constituting the wall forming the heel 8.

The angle between the lateral edges 3, 4 of the bottom 12 and the lateral edges 22, 23 of the heel 8 is usually between 140° and 170° and of course depends on the angular width of the portion.

According to the invention, a tearing element or "puller" (shown in dotted line in FIG. 1) is fixed to the sheet 1 on the side adapted to form the internal surface of the shell.

This tearing element comprises two strips 25 and 26 each having a very flattened "Z" shape. The strip 25 has a first rectilinear portion 27 extending along the heel forming part 8 along the lateral edge 22 of this heel and in a direction parallel to the latter. This first portion 27 is extended by a second rectilinear portion 28 which extends along the bottom 2, along the lateral edge 4 and in a direction parallel to the latter. This second rectilinear portion 28 is extended by a third rectilinear portion 29 disposed along the median axis 31 of the triangular bottom 2 (passing through the point 30 of this bottom) in a direction parallel to this axis and on the side adjacent the edge 4. The strip 26 comprises a first rectilinear portion 32 extending along the part forming the heel 8, along the lateral edge 23 and in a direction parallel to the latter. This first portion 32 is extended by a second rectilinear portion 33 extending on the bottom 2 along the lateral edge 3 and in a direction parallel to the latter. This second portion 33 is extended by a third rectilinear portion 34 which is disposed along the median axis 31 and parallel to the latter on the side adjacent the edge 4 and which thus overlaps the end of the portion 29 of the other strip, but extending beyond this end. The portion 34 is sufficiently long to extend beyond the sheet 1 and permit the consumer to take hold of it. The portion 34 thus constitutes the single pulling tongue.

The cut-out strips 25 and 26 made from a thermoweldable material are thermowelded to each other and to the sheet 1. The portions 29 and 34 are thus welded to each other.

In the course of the shaping into a shell shown in FIG. 2, the zones 19 and 21 connecting the lateral walls 6 and 7 and the wall forming the heel 8 are folded up from the bottom 2 in their middle part and the triangles thus formed 35 and 36 are folded onto the lateral walls 6 and 7 respectively. As concerns the zone 16 including the end of the strips 25 and 26, it is also folded in its middle part corresponding to the median axis 31 and the triangle 37 thus formed is folded onto the wall 6. The portion 34 of the strip 26 forming the pulling tongue thus appears on the lateral wall 6.

Poured into the shell thus formed, in the hot state is a given quantity of cheese up to a height equal to the height of the walls 6 and 7 and the heel 8.

Placed on the surface of the cheese is a second sheet 38 having dimensions identical to those of the bottom 2, onto which are folded over the marginal portions 9, 11 and 12. The marginal portions 9, 11 and 12 are then welded to the periphery of the sheet 38.

Figure 4:
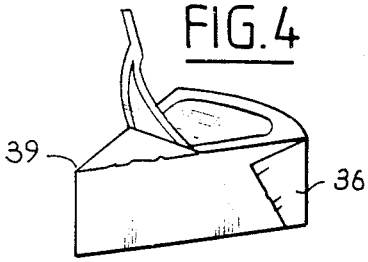
FIGS. 4 to 6 are views of various stages of the opening of the wrapper of FIG. 3.
Figure 5:
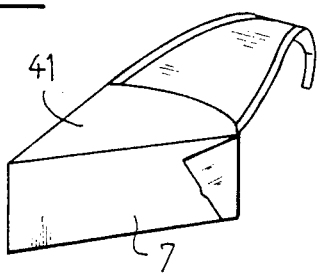
Figure 6:
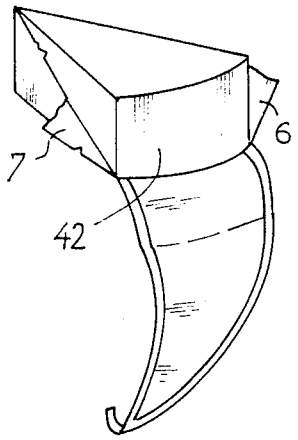

The wrapper according to the present invention is opened in the manner shown in FIGS. 4 to 6. Upon opening, the consumer takes hold of the wrapped portion between the thumb and the index finger on one hand, on the two lateral walls 6 and 7 and takes hold of the pulling tongue 34 of the tearing element 24 with the other hand. By pulling on this tongue 34 in a single movement, he uncovers in succession the upper point 39 of the portion (FIG. 4), then the triangular upper side 41 (FIG. 5) and lastly the whole of the heel 42, and in this way completely releases the lateral walls 6 and 7 which now only has to fold back in accordance with the diagram of FIG. 6.

It is clear that the wrapper according to the invention permits a complete opening owing to a tearing element whose "Y " shape matches the folding edges of the portion, whence the great advantage of not leaving upon opening residues of processed cheese in the edges and to effect, in distinction to the other systems, a real opening along all of the edges. Further, the user practically does not need to reflect in order to open the wrapper, the succession of the opening operations being particularly logical. Further, owing to the existence of the welded ends of the two branches 25 and 26 and of a single pulling tongue, the taking hold of the tongue is facilitated and there is thus eliminated any risk of a bad gripping due to the non-superposition of the two ends. Finally, the opening is particularly easy to achieve and in this respect it should be noted that the folding of the zones 19 and 21 against the lateral walls 6 and 7 facilitates the tearing along the lateral edges of the heel.

Figure 7:
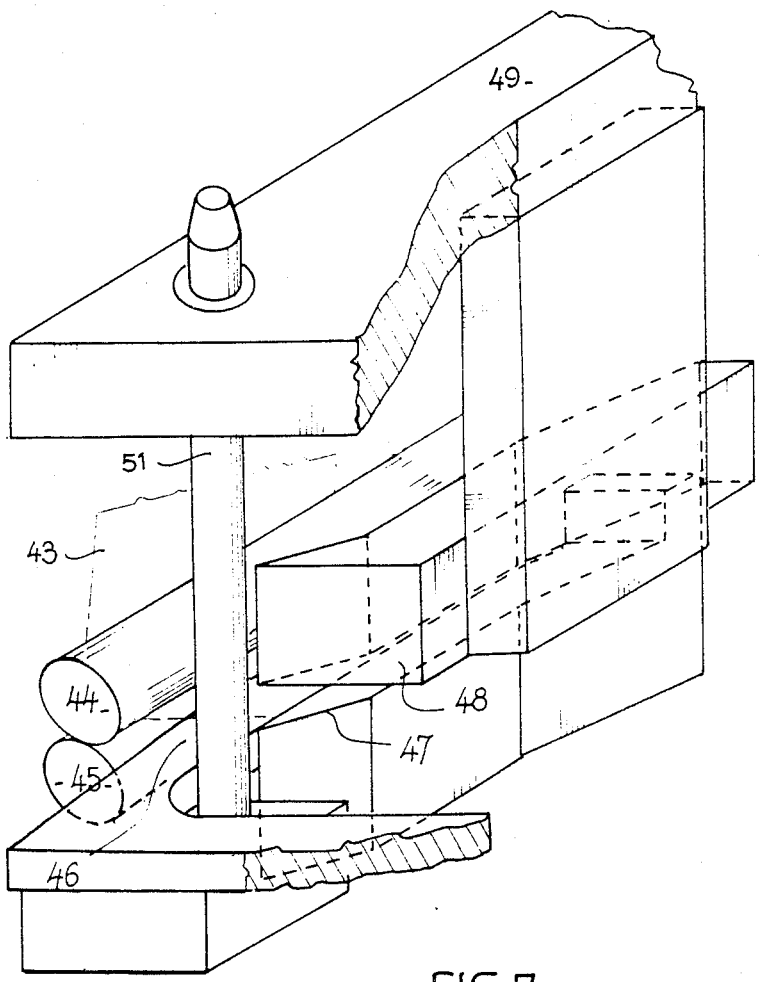
FIG. 7 is a perspective view of an apparatus for cutting out tearing strips.

An apparatus has been shown in FIG. 7 for the cutting of the strips such as the strips 25 and 26.

A strip of sheet material 43 intended to form the strips is fed by means of rollers 44, 45 to the platform 46 of a cutting element comprising a fixed blade 47 in the plane of this platform and a movable blade 48 connected to a driving element 49 which is connected to a guide element 51 sliding in the platform 46.

The blades 47 and 48 have the profile of a strip to be cut out.

When the blade 48 moves downwardly, it cuts the sheet 43 extending beyond the fixed blade 47. A strip of given width is thus cut out and brought by the lower edge of the blade 48 toward the bottom where it is placed on a sheet adapted to form the shell. After placing a second strip in position, the two strips are welded to the sheet intended to form the shell.

What is claimed is:

1. A fluidtight packing wrapper for pasty products and in particular food products such as processed cheese, said wrapper having a triangular base and being capable of being completely opened, said wrapper comprising a first sheet cut out along a suitable contour and folded so as to form a bottom having a triangular shape, two lateral walls adjoining the bottom of the first sheet and a wall forming a heel adjoining the bottom of the first sheet, a second sheet having a triangular shape and placed flat on the surface of a product which is to be packed and which is placed in said first sheet, and a tearing element fixed inside said first sheet and including only a single pulling tongue, the tearing element comprising two tearing strips each extending in a first portion of each strip along one of the lateral edges of the heel and in a direction parallel to said one lateral edge and, in a second portion of each strip, along one of the lateral edges of the bottom and in a direction parallel to said one lateral edge, said two strips being in at least partly overlapping relation to each other in a third portion of each strip in the vicinity of a point of the triangular bottom so as to form said only single pulling tongue which extends beyond said first sheet.

2. A wrapper according to claim 1, wherein said third portions of the two strips which are at least partly superposed are disposed on the same side of a median axis of the triangular bottom and along the latter.

3. A wrapper according to claim 1, wherein the first sheet of the wrapper is folded in such manner that two substantially triangular portions of the first sheet, which are formed along said lateral edges of the heel, are folded onto said lateral walls of the first sheet.

4. A wrapper according to claim 1, wherein the two tearing strips constituting the tearing element are two strips which are suitably cut out and welded to each other in said overlapping portions thereof.

5. A wrapper according to claim 1, wherein the tearing strips are welded together and fixed to the first sheet by a single thermowelding operation.

6. A wrapper according to claim 1, wherein each of said tearing strips has a flattened Z shape.

* * * * *